US007080610B2

(12) United States Patent
Bauer et al.

(10) Patent No.: US 7,080,610 B2
(45) Date of Patent: Jul. 25, 2006

(54) COOLED PISTON CONSISTING OF TWO PARTS

(75) Inventors: Valery Bauer, Waiblingen (DE); Hanspeter Wieland, Ditzingen (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/512,657

(22) PCT Filed: Apr. 17, 2003

(86) PCT No.: PCT/DE03/02228

§ 371 (c)(1),
(2), (4) Date: Oct. 25, 2004

(87) PCT Pub. No.: WO03/091562

PCT Pub. Date: Nov. 6, 2003

(65) Prior Publication Data

US 2005/0155560 A1 Jul. 21, 2005

(30) Foreign Application Priority Data

Apr. 25, 2002 (DE) ..... 102 18 477

(51) Int. Cl.
*F01P 1/04* (2006.01)

(52) U.S. Cl. ..... 123/41.35; 123/193.6; 92/172

(58) Field of Classification Search ..... 123/41.35, 123/41.38, 193.6; 92/172
See application file for complete search history.

(56) References Cited

U.S. PATENT DOCUMENTS

| | | | | |
|---|---|---|---|---|
| 2,035,692 | A | 3/1936 | Dietrich | |
| 5,113,817 | A | 5/1992 | Wieland et al. | |
| 5,996,545 | A | 12/1999 | Kling | |
| 6,023,619 | A * | 2/2000 | Kaminsky | 455/411 |
| 6,209,510 | B1 | 4/2001 | Brogdon et al. | |
| 6,491,013 | B1 * | 12/2002 | Gaiser et al. | 123/193.6 |
| 6,763,758 | B1 * | 7/2004 | Kemnitz et al. | 92/186 |

FOREIGN PATENT DOCUMENTS

| | | |
|---|---|---|
| DE | 3732925 | 12/1988 |
| DE | 3832159 | 3/1990 |
| DE | 3935091 | 5/1990 |
| DE | 4425942 | 1/1996 |
| DE | 19733814 | 2/1998 |
| DE | 197 08 892 | 5/1998 |
| EP | 0787898 | 8/1997 |
| FR | 2575227 | 6/1986 |
| JP | 38640 | 1/1991 |
| WO | WO0173275 | 10/2001 |

* cited by examiner

*Primary Examiner*—Tony M. Argenbright
*Assistant Examiner*—Katrina Harris
(74) *Attorney, Agent, or Firm*—Collard & Roe, P.C.

(57) ABSTRACT

Cooled two-part piston for internal combustion engines having an upper piston part containing the piston ring grooves and piston pin bosses, and a piston skirt connected with the former exclusively by way of a piston pin. The upper piston part has a cooling oil annular channel that is open towards the piston skirt, into which channel the cooling oil is introduced, and discharged. There are collecting pockets attached at the upper end of the piston skirt, which faces the upper piston part. The pockets at least partially cover the cooling oil annular channel. When the engine and piston are arranged horizontally, a tub-shaped recess is provided in an interior bottom region of the piston skirt for accommodating cooling oil. The circumferential wall limitation of the recess is formed exclusively by a wall of the inside piston skirt.

4 Claims, 1 Drawing Sheet

COOLED PISTON CONSISTING OF TWO PARTS

CROSS REFERENCE TO RELATED APPLICATIONS

Figure 1:
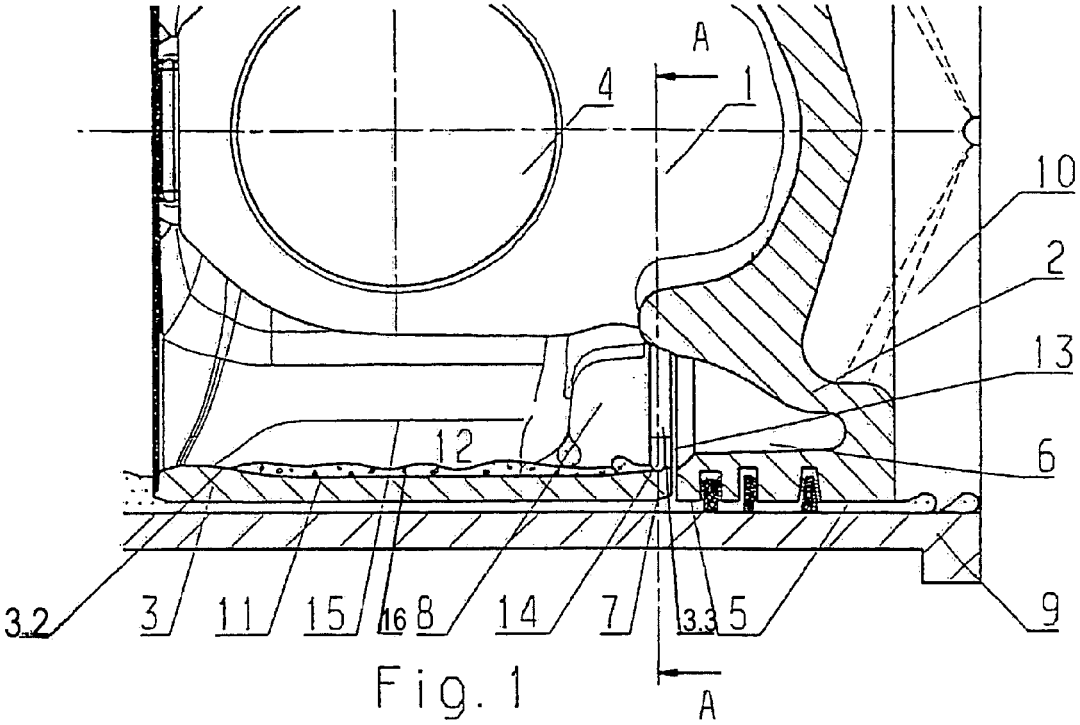

Applicants claim priority under 35 U.S.C. §119 of German Application No. 102 18 477.1 filed on Apr. 25, 2002. Applicants also claim priority under 35 U.S.C. §365 of PCT/DE03/02228 filed on Apr. 17, 2003. The international application under PCT article 21(2) was not published in English.

BACKGROUND OF THE INVENTION

The invention relates to a cooled two-part paiston.

Such a piston is known, for example, from DE 37 32 925 C1.

If an internal combustion engine having such a piston is now supposed to be used in an approximately horizontal installation position, in operation (e.g. below-floor engine, Boxer engine), there is the risk that cooling oil will collect in the lower region, on the cylinder wall, and get into the combustion chamber, going past the piston rings, particularly when the internal combustion engine is shut off and while it is standing. Aside from the undesirable oil consumption, this causes stronger smoke development (e.g. blue smoke) to occur when the internal combustion engine is started.

From the state of the art, reference with regard to smoke development when starting, in the case of an internal combustion engine having a cylinder arranged horizontally should also be made to DE 197 08 892 C1, in which it is proposed, in the case of a one-part piston not having liquid cooling, to form a labyrinth-like pressure equalization passage between the combustion chamber and the crank chamber, whereby the piston rings that face the combustion chamber are provided with recesses, in each instance, which connect the annular space between adjacent piston rings with the bottom of the ring groove, in each instance.

Furthermore, in the case of a horizontal internal combustion engine, a one-part piston without liquid cooling is known from JP 3-8640 U, which piston is provided with an axially running recess on the outside of its skirt, which recess is connected with a feed-back bore in the cylinder, to the crankcase chamber, in order to drain oil that has been stripped from the piston rings.

SUMMARY OF THE INVENTION

It is therefore the task of the present invention to improve an internal combustion engine having a piston of the type according to the main claim, with at least one horizontally aligned cylinder in the installed position of the internal combustion engine, in such a manner that a reduction in the so-called blue smoke when starting, and of the oil loss, is achieved with little effort.

This task is accomplished, according to the invention, with the characterizing features of claim 1.

Other practical embodiments according to the invention are contained in the dependent claims.

BRIEF DESCRIPTION OF THE INVENTION

The invention will be explained in greater detail below, using an exemplary embodiment shown in the drawing.

Figure 2:
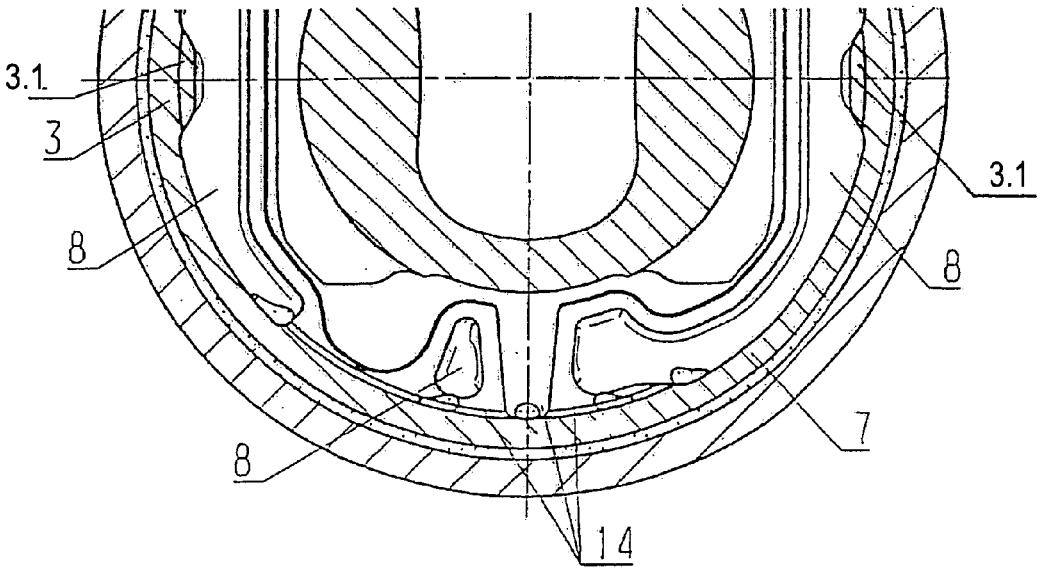

This shows:

FIG. 1 a longitudinal cross-section of a piston according to the invention;

FIG. 2 a top view of the piston skirt.

DETAILED DESCRIPTION OF THE PREFERRED EMBODIMENT

The cooled two-part piston 1 for an internal combustion engine arranged horizontally in operation consists of an upper piston part 2 made of steel, and a piston skirt 3 made of aluminum, whereby these two parts are connected with one another in articulated manner, by way of a piston pin 4 (articulated piston). In the upper piston part 2, a cooling oil annular channel 6, open towards the piston skirt 3, is provided radially within the piston ring groove region 5, into which channel the cooling oil is injected in known manner, from the crank chamber. The cooling oil annular channel 6 is covered, at least in part, by the collecting pockets 8 on the piston skirt 3, which are attached to the end 7 that faces the upper piston part 2. The collection pockets 8 can also be configured as a continuous annular chamber, so that they completely cover the cooling oil annular channel 6.

In order to prevent cooling oil between the upper piston part 2 and the upper end 7 of the piston skirt 3 from collecting on the cylinder wall (i.e. cylinder sleeve wall 9) when the engine is shut off, and getting into the combustion chamber 10, a tub-shaped recess 12 is provided on the inside 11 of the piston skirt 2, in which this cooling oil 16 collects without having a harmful effect. In order to allow easier flow into this recess 12, an oil groove 14 is provided, starting from the upper edge 13 of the piston skirt 3, which groove opens into the recess 12. The recess 12 should extend up to approximately 60°, seen in the circumference direction, and is delimited laterally by the thickened wall region 3.1. The length in the axial direction (longitudinal piston axis) and the depth of the recess 12 is established in accordance with the desired accommodation volume of cooling oil. On the crankcase side, the recess is deliminted by a stepless thickened wall region 3.2 and on the combustion chamber side by the walls 3.3. In order to avoid harmful edges 15 on the inside 11 of the piston skirt 3, the circumference transition of the recess 12 into the inside wall 11 of the piston skirt 3 should occur gradually, in other words without steps.

Using such an embodiment, an improvement in oil consumption and smoke development when starting is achieved in a manner that is simple in design, for an internal combustion engine having a piston/cylinder axis that runs horizontally.

The invention claimed is:

1. Cooled two-part piston for internal combustion engines, comprising:

an upper piston part containing piston ring grooves and piston pin bosses, and a piston skirt connected with the upper piston part exclusively by way of a piston pin in an articulated manner, wherein the upper piston part is provided with a cooling oil annular channel that is open towards the piston skirt, radially within a piston ring groove region, into which channel the cooling oil is introduced and discharged, and wherein collecting pockets are attached at an upper end of the piston skirt facing the upper piston part, said pockets at least partially covering the cooling oil annular channel;

and wherein when the internal combustion engine and the piston are arranged horizontally, a tub-shaped recess is provided in inside bottom region of the piston skirt for accommodating cooling oil, and wherein the tub-shaped recess has a circumferential wall limitation formed exclusively by a wall of the inside piston skirt.

2. Piston as recited in claim 1, wherein there is an oil groove made in the piston skirt starting from an upper edge oft the piston skirt, said oil groove leading to the recess.

3. Piston as recited in claim 1, wherein the recess extends over a width up to approximately 60°, over the circumference.

4. Piston as recited in claim 1, wherein the recess makes a transition into the inside wall of the piston skirt, without any steps, on the circumference.

* * * * *